US006841196B2

(12) United States Patent
Takimoto et al.

(10) Patent No.: US 6,841,196 B2
(45) Date of Patent: Jan. 11, 2005

(54) METHOD OF FORMATION OF COATING FILM ON SURFACE OF CYLINDRICAL BASE MATERIAL AND COATING LAYER FORMING APPARATUS

(75) Inventors: Kouichi Takimoto, Kitaibaraki (JP); Kiyoshi Yasuda, Kitaibaraki (JP); Hitoshi Hotta, Kitaibaraki (JP)

(73) Assignee: NOK Kluber Co., LTD, Tokyo (JP)

( * ) Notice: Subject to any disclaimer, the term of this patent is extended or adjusted under 35 U.S.C. 154(b) by 0 days.

(21) Appl. No.: 10/290,273

(22) Filed: Nov. 8, 2002

(65) Prior Publication Data

US 2003/0064152 A1 Apr. 3, 2003

Related U.S. Application Data

(63) Continuation of application No. PCT/JP02/00695, filed on Jan. 30, 2002.

(30) Foreign Application Priority Data

Jan. 30, 2001 (JP) ..... 2001-022391

(51) Int. Cl.[7] ..... B05D 3/12
(52) U.S. Cl. ..... 427/240; 427/356; 427/358
(58) Field of Search ..... 427/240, 356, 427/358; 118/107, 320, 413, 416

(56) References Cited

U.S. PATENT DOCUMENTS 3,900,595 A * 8/1975 Giori ..... 427/542

FOREIGN PATENT DOCUMENTS

| | | |
|---|---|---|
| EP | 1 065 004 A1 * | 1/2001 |
| JP | 60-021214 | 2/1985 |
| JP | 02-095470 | 4/1990 |
| JP | 10-331970 | 12/1998 |

* cited by examiner

*Primary Examiner*—Katherine A. Bareford
(74) *Attorney, Agent, or Firm*—Jacobson Holman PLLC

(57) ABSTRACT

A method of formation of a coating film on the surface of a cylindrical base material such as a piston wherein a waste of the lubricant coating solution is prevented and a lubrication action is maintained. A cylindrical base material is rotably supported horizontally on a rotating support device and in rotation, a coating solution is supplied to a coating surface, and a coating film is coated on the surface of the cylindrical base material. A coating former equipped with a blade is inclined at an angle of 20° to 80° with respect to a tangential direction of rotation, the blade is separated from the coating surface by exactly a coating layer thickness, and further the cylindrical base material is rotated by ¼ of a turn or more.

12 Claims, 10 Drawing Sheets

19 : COATING FORMER
A : PART
C : COATING LAYER
G : ROTATION DIRECTION
P : CONNECTION DIRECTION
θ : INCLINED ANGLE
E : EXCESS COATING SOLUTION

19 : COATING FORMER
SP : DETACHMENT START POSITION
EP : DETACHMENT END POSITION
α : NO. OF TURNS (ROTATIONAL ANGLE) OF ROTATION FROM START OF DETACHMENT TO END

METHOD OF FORMATION OF COATING FILM ON SURFACE OF CYLINDRICAL BASE MATERIAL AND COATING LAYER FORMING APPARATUS

This is a continuation of PCT/JP02/00695, filed Jan. 30, 2002 and published in Japanese.

TECHNICAL FIELD

The present invention relates to a method of formation of a lubricant coating film or other coating film on the surface of a cylindrical base material or tubular base material, for example, a metallic piston used for a compressor, and to a coating layer forming apparatus.

BACKGROUND ART

As the cylindrical base material on which a coating is to be formed, a piston of a compressor is given as an example. A piston of a compressor is a piston in a piston type compressor used, for example, for an air-conditioning system of automobiles. It is used for compressing coolant gas etc. in a cylinder by reciprocating motion of the piston in the cylinder. A coating having a high lubrication function is applied to such a piston.

When forming a coating layer having such a high lubrication function on the surface of a piston of a compressor or other cylindrical base material or tubular base material (hereinafter, in the present specification, these will be referred to as a "cylindrical base material" to represent the same, and the term "cylindrical base material" will be used in the meaning including not only a cylindrical base material, but also a tubular base material) using a coating layer forming apparatus, part of the lubricant coating solution supplied to the coating surface of the part is scraped off by the coating former located in the vicinity of the surface of the piston and deposited on its surface. It was confirmed that when a large amount of scraped off excess lubricant coating solution build up at the coating former, the projection of the coating film became larger when the coating former was detached (separated) from the surface of the coating layer of the piston on which the lubricant coating solution was formed.

When such a large projection of the coating film is generated, it suffers from a disadvantage that a uniform coating film cannot be formed on the surface of the piston. Depending on the size of the projection of the coating film, the lubricant coating solution will sag and foaming will occur in the lubricant coating solution at the drying and baking process performed after coating the coating solution. To prevent such foaming of the lubricant coating solution, the drying time is made longer and therefore the productivity in coating the piston is lowered.

As a method for solving such a problem, Japanese Patent Application No. 11-7552 discloses, as one example, a method for removing excess lubricant coating solution deposited on a coating former by using an apparatus explained in detail later as Comparative Example 2 with reference to FIG. 14. Namely, it is a method of mounting a plurality of coating formers 119 along the surface of a rotating body, performing the coating while successively switching the coating formers 119, and removing the excess lubricant coating solution by washing in a washing tank 130.

DISCLOSURE OF THE INVENTION

An object of the present invention is as follows: When the method disclosed in Japanese Patent Application No. 11-7552 is applied, as will be explained in detail as Comparative Example 2, the removed excess lubricant coating solution becomes wasted. A lubricant coating solution is expensive, so the cost taken for the formation of a lubricant coating on a piston becomes expensive due to the waste of the excess coating solution. Particularly, when forming a lubricant coating on a large number of pistons, this expensiveness of the cost becomes an obstacle to commercialization.

Further, usually, the drying and baking process is carried out after the film formation process, but the thickness of the coating layer on the piston sometimes changes due to such work, so maintenance of the quality of the final product becomes a problem.

Further, a piston or other cylindrical base material is a part produced by mass production, so a method for forming a coating film on the surface of a cylindrical base material with a higher productivity has been demanded.

As an example of the formation of a film on a cylindrical base material, the formation of a lubricant coating on a piston of a compressor was illustrated, but the invention is not limited to the formation of a lubricant coating on a piston; similar problems to the above are encountered even when forming a film using a coating solution on other coated objects.

An object of the present invention is to provide a method for forming a coating film on the surface of a cylindrical base material which enables the waste of the lubricant coating or other coating to be kept small and enables the formation of a coating film of a low price and a high quality.

Another object of the present invention is to provide a method for forming a coating film on the surface of a cylindrical base material which enables the thickness of the lubricant coating layer to be maintained at a high precision after completion of the drying and baking performed as final steps.

Still another object of the present invention is to provide a method for forming a coating film on the surface of a cylindrical base material satisfying the above demands and enabling a high productivity.

Another object of the present invention is to provide a coating layer forming apparatus suitable for implementing the above method for forming a coating film on the surface of a cylindrical base material.

According to the present invention, there is provided a method of forming a coating film on the surface of a cylindrical base material including: a first step of inclining a coating former at an inclined angle in a range of 20° to 80° with respect to a tangential direction of rotation of a coating surface of a cylindrical base material rotatably supported horizontally, making a front end of the coating former approach the coating surface separated by exactly a clearance of a predetermined thickness, and coating a coating solution supplied from a coating feeder on the coating surface of the rotating cylindrical base material in a state where the cylindrical base material supported at the rotating support device is rotated by exactly a first number of turns at a first rotational speed to form a coating layer, and a second step of further separating the front end of the coating former from the position which the front end of the coating former approached the coating surface of the cylindrical base material separated therefrom by exactly the clearance of the thickness after the coating solution is coated on the coating surface of the cylindrical base material, then rotating the cylindrical base material at least ¼ of a turn at a second rotational speed from a detachment start position of the front end of the coating former to a position where a detachments has completely ended.

According to the present invention, there is also provided a coating layer forming apparatus having: a rotating support device for rotatably supporting a cylindrical base material horizontally, a coating feeder for discharging a coating solution to a coating surface of the cylindrical base material from above the horizontally supported cylindrical base material, a layer forming device having a coating former whose front end is formed in a blade shape and having means for inclining the coating former at an inclined angle in a range from 20° to 80° with respect to a tangential direction of rotation of the coating surface of the horizontally supported cylindrical base material and for making the front end approach the coating surface of the cylindrical base material separated by exactly a clearance of the predetermined thickness, a rotation driving means for causing the horizontally supported cylindrical base material to rotate, and a controlling means. The controlling means controls the rotation driving means to make the cylindrical base material supported at the rotating support device rotate by exactly a first number of turns at a first rotational speed and in that state coat the coating solution supplied from the coating feeder on the coating surface of the rotating cylindrical base material to form the coating layer, and controls the layer forming device to further move the front end of the coating former away from the position which the front end of the coating former approached the coating surface of the cylindrical base material separated therefrom by exactly the clearance of the thickness after the coating solution is coated on the coating surface of the cylindrical base material and controls the rotation driving means to make the cylindrical base material rotate at least ¼ of a turn at a second rotational speed from the detachment start position of the front end of the coating former to a position where the detachment has completely ended.

BRIEF DESCRIPTION OF THE DRAWINGS

FIGS. 9A and 9B are views illustrating an example of a coating former in the layer forming device illustrated in FIG. 2, wherein FIG. 9A is a sectional view thereof, and FIG. 9B is a plan view thereof.

BEST MODE FOR CARRYING OUT THE INVENTION

Figure 1:
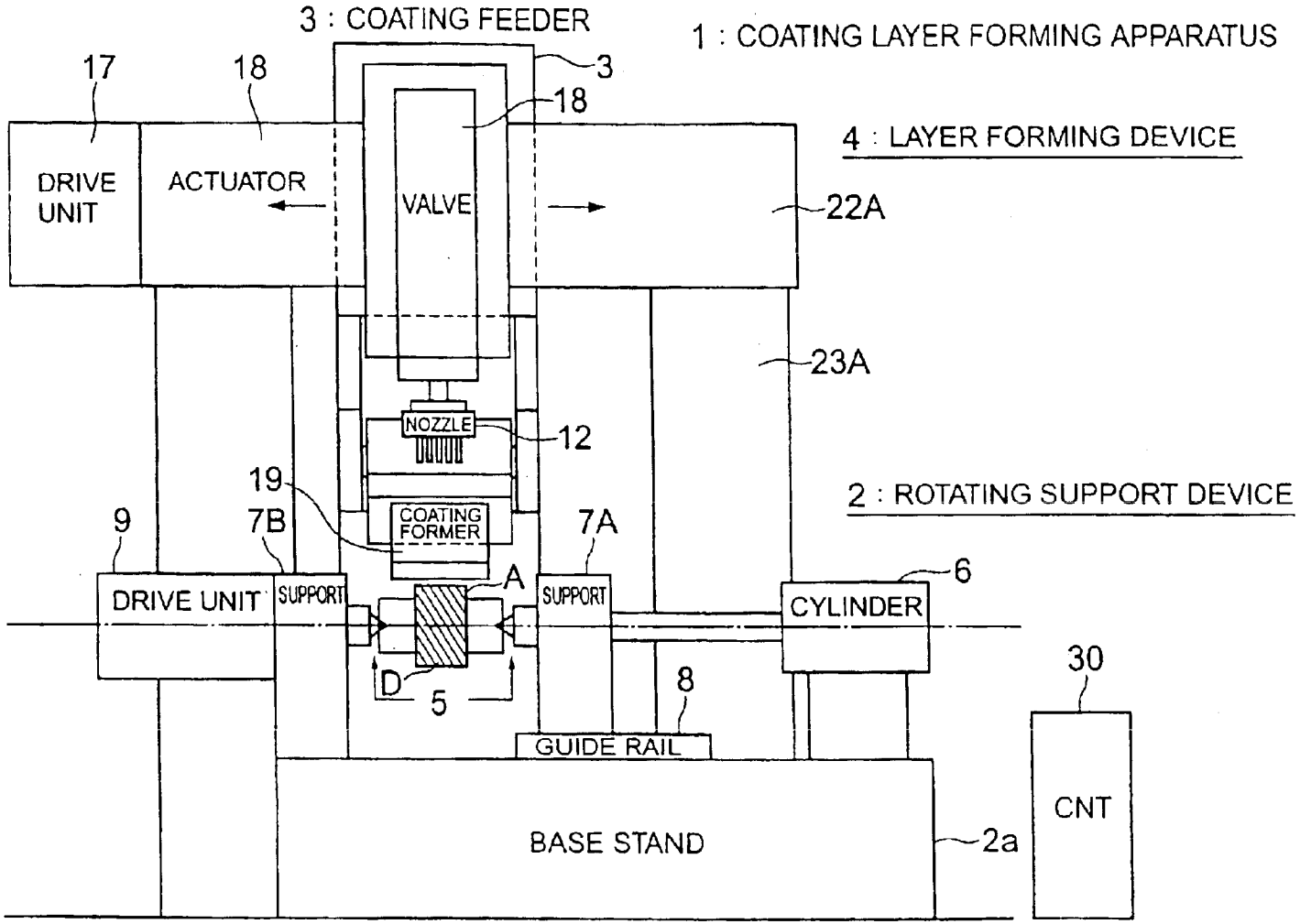
FIG. 1 is a front view of the schematic configuration of a coating layer forming apparatus according to an embodiment of the method for forming a coating film on the surface of a cylindrical base material of the present invention and a coating layer forming apparatus used for working the same.

Preferred embodiments of the present invention will be explained with reference to the attached drawings.

According to a first aspect of the present invention, there is provided a method of forming a coating film on the surface of a cylindrical base material comprising (a) a first step of inclining a coating former (19) at an inclined angle (θ) in a range of 20° to 80° with respect to a tangential direction of rotation (P) of a coating surface (D) of a cylindrical base material (A) rotatably supported horizontally, making a front end (191) of the coating former (19) approach the coating surface (D) separated by exactly a clearance of a predetermined thickness (t), and coating a coating solution (B) supplied from a coating feeder (3) on the coating surface (D) of the rotating cylindrical base material (A) in a state where the cylindrical base material (A) supported at the rotating support device (2) is rotated by exactly a first number of turns at a first rotational speed to form a coating layer (C) and (b) a second step of further separating the front end (191) of the coating former (19) from the position which the front end (191) of the coating former (19) approached the coating surface (D) of the cylindrical base material (A) separated therefrom by exactly the clearance of the thickness (t) after the coating solution (B) is coated on the coating surface (D) of the cylindrical base material (A), then rotating the cylindrical base material (A) at least ¼ of a turn at a second rotational speed from a detachment start position (SP) of the front end (191) of the coating former (19) to a position (EP) where a detachment has completely ended.

Preferably, it further includes a third step of separating the coating former (19) from the coating layer (C) of the cylindrical base material (A), then dismounting the cylindrical base material (A) from the rotating support device (2) and drying and baking the coating layer (C) part of the cylindrical base material (A).

According to a second aspect of the present invention, there is provided a coating layer forming apparatus comprising a rotating support device (2) for rotatably supporting a cylindrical base material (A) horizontally, a coating feeder (3) for discharging a coating solution (B) to a coating surface (D) of the cylindrical base material (A) from above the horizontally supported cylindrical base material (A), a layer forming device (4) having a coating former (19) whose front end (191) is formed in a blade shape and having means (21, 22A, 22B, 23A, 23B) for inclining the coating former (19) at an inclined angle (θ) in a range from 20° to 80° with respect to a tangential direction of rotation (P) of the coating surface (D) of the horizontally supported cylindrical base material (A) and for making the front end (191) approach the coating surface (D) of the cylindrical base material (A) separated by exactly a clearance of the predetermined thickness (t), a rotation driving means (9) for causing the horizontally supported cylindrical base material (A) to rotate, and a controlling means (30), wherein the controlling means (a) controls the rotation driving means (9) to make the cylindrical base material (A) supported at the rotating support device (2) rotate by exactly a first number of turns at a first rotational speed and in that state, coat the coating solution (B) supplied from the coating feeder (3) on the coating surface (D) of the rotating cylindrical base material (A) to form the coating layer (C) and (b) controls the layer forming device (4) to further separate the front end (19) of the coating former (19) from the position which the front end (191) of the coating former (19) approached the coating surface (D) of the cylindrical base material (A) separated therefrom by exactly the clearance of the thickness (t) after the coating solution (B) is coated on the coating surface (D) of the cylindrical base material (A) and controls the rotation driving means (9) to make the cylindrical base material (A) rotate at least ¼ of a turn at a second rotational speed from the detachment start position (SP) of the front end (191) of the coating former (19) to a position (EP) where the detachment has completely ended.

The method of formation of a coating film on the surface of a cylindrical base material and the coating layer forming apparatus of the present invention explained above will become clearer from the following description given with reference to the attached drawings. Below, a description will be given of the preferred embodiments of the method of formation of a coating film on the surface of a cylindrical base material of the present invention and the coating layer forming apparatus used for working the same.

The object to which the coating is formed on the surface thereof in the present invention is a piston of a compressor or other cylindrical or tubular base material (member) usually having a rotationally symmetric surface. These will be referred to all together a "cylindrical base material". In this specification, the description "cylindrical base material" will be used in a meaning including also a tubular base material.

As an example of the cylindrical base material to which a coating is to be formed on the surface thereof in the present invention, a case of forming a lubricant coating on a piston of a compressor will be exemplified.

Figure 2:
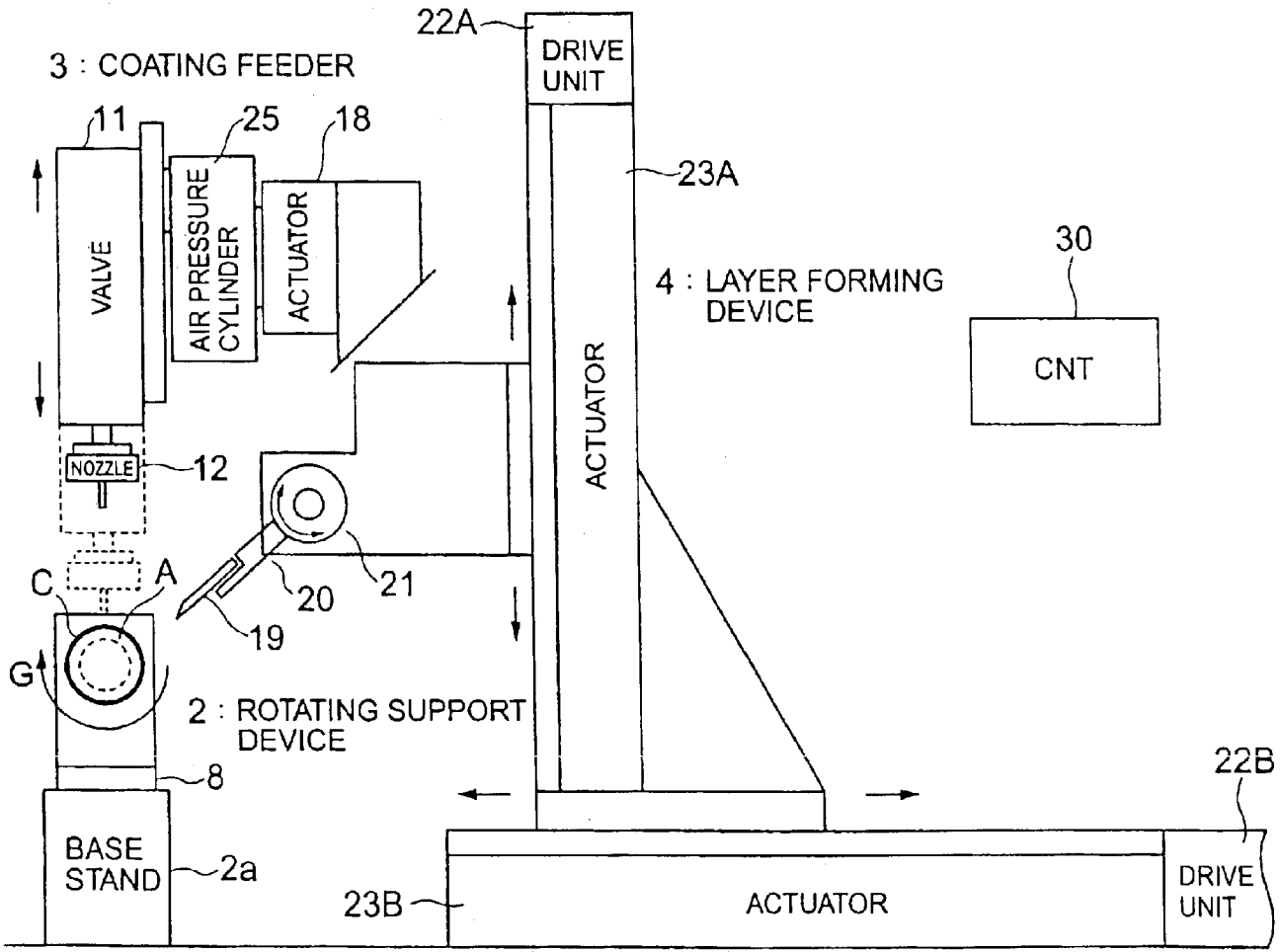
FIG. 2 is a schematic sectional side view of the coating layer forming apparatus illustrated in FIG. 1.

In the present embodiment, the method of forming a lubricant coating on a piston of a compressor is carried out by using the coating layer forming apparatus illustrated in FIG. 1 and FIG. 2.

Coating Layer Forming Apparatus

FIG. 1 is a front view illustrating the schematic configuration of the coating layer forming apparatus used for impleting the method of formation of a coating film on the surface of a cylindrical base material of the present invention, while FIG. 2 is a schematic sectional side view of the coating layer forming apparatus illustrated in FIG. 1.

A coating layer forming apparatus 1 illustrated in FIG. 1 and FIG. 2 is comprised of a rotating support device 2, coating feeder 3, layer forming device 4, and general coating layer formation control unit 30.

The rotating support device 2 supports the piston of the compressor, the surface of which the lubricant coating is to be formed (hereinafter, this will be referred to as the "part A" or "member A") horizontally so as to able to rotate.

The coating feeder 3 supplies the lubricant coating solution for coating the lubricant on the surface of the part A from a nozzle 12 to the coating surface D of the surface of the part A.

The layer forming device 4 holds and controls a coating former 19 having a front end directed to the coating surface D of the part A.

The general coating layer formation control unit 30 performs various controls in the coating layer forming apparatus 1. The general coating layer formation control unit 30 is configured by using a microcomputer comprised of for example a central processing unit (CPU) and a memory storing various control processing programs therein and performs the following various control in the coating layer forming apparatus 1 by operating the CPU to run the various control processing programs stored in the memory.

Piston of Compressor (Part A)

Figure 3:
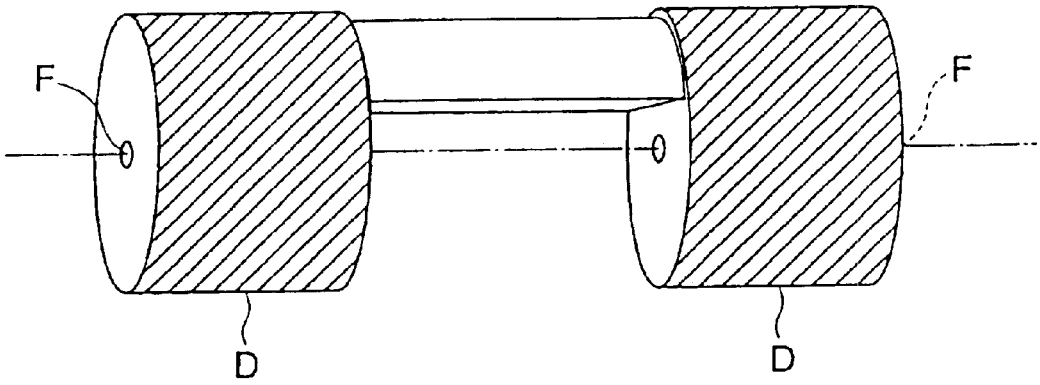
FIG. 3 is a schematic view of the configuration of a piston of a compressor as an example of the cylindrical base material (cylindrical part) on which a coating is to be formed by a method for formation of a coating film on the surface of a cylindrical base material of the present invention.

The part A (piston of compressor) is for example a piston having a structure illustrated in FIG. 3. FIG. 3 is a schematic view of the configuration of the piston of the compressor as the part A to be formed with the coating layer. The piston used for the compressor exhibits a cylindrical shape. A lubricant coating is formed on its surface so that it can withstand severe reciprocating motion. A case where the coating layer is formed at two portions on the two sides of the piston illustrated in FIG. 3 is exemplified.

Centering holes F, F for the rotatable horizontal support by a positioner 5 of the rotating support device 2 are formed in the two end surfaces of the piston. The coating surface D is provided on the surface.

Figure 4:
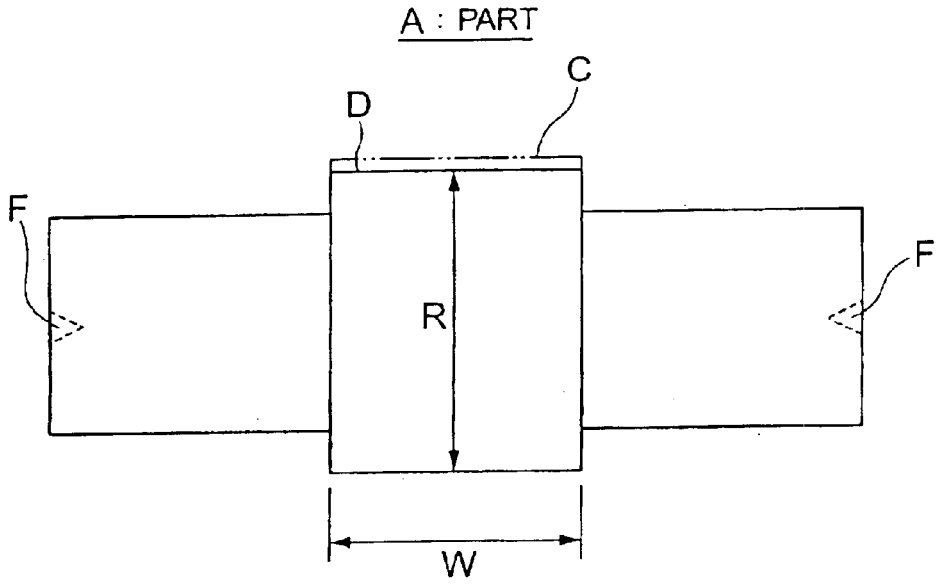
FIG. 4 is a view simplifying the piston illustrated in FIG. 3 to schematically illustrate the representative parts.

FIG. 4 is a simplified view illustrating the piston illustrated in FIG. 3. The piston illustrated in FIG. 4 shows an example wherein the coating layer is provided at only one position at the center.

In the piston illustrated in FIG. 3, the coating layer is formed at two positions, but for simplicity of the description, a piston wherein the coating layer exists at only one portion illustrated in FIG. 4 will be explained as a representative case.

The dimensions of the piston illustrated in FIG. 4 are, for example, a width W of the coating surface D of 22 mm and a diameter R of 32 mm.

Rotating Support Device

The rotating support device 2 is comprised of a base stand 2*a*, positioner 5 for attaching and detaching the part A, guide rail 8 mounted on the base stand 2*a*, right side support 7A able to move to the left and right in FIG. 1 along the guide rail 8, air pressure cylinder 6 mounted on the base stand 2*a*, left side support 7B mounted on the base stand 2*a*, and drive unit 9 connected to the left side support 7B.

The positioner 5 has two conical projections fixed to the supports 7A and 7B arranged at facing positions. The part A is supported (held) horizontally by these two conical projections abutting against (or engaging with) the centering holes F, F in the two end surfaces of the part A illustrated in FIG. 3 and FIG. 4.

The part A is supported (held) by the positioner 5 by the general coating layer formation control unit 3 driving the air pressure cylinder 6 to move the right side support 7B, to which the right side conical projection of the positioner 5 is fixed, along the guide rail 8 fixed to the base stand 2*a* to the right and left in FIG. 1. Namely, when the part A is supported by the positioner 5, if the air pressure cylinder 6 once moves the right side support 7A to the right side under the control of the general coating layer formation control unit 30 to move the right side conical projection of the positioner 5 away from the left side conical projection of the positioner 5, the part A is arranged between the two conical projections of the positioner 5, then the air pressure cylinder 6 makes the right side support 7A move to the left side of FIG. 1 along the guide rail 8 under the control of the general coating layer formation control unit 30, the part A can be supported horizontally by engaging the conical projections on the two sides of the positioner 5 with the centering holes F, F at the two end surfaces of the part A. Note that, when the part A is detached from the positioner 5, the general coating layer formation control unit 30 controls the air pressure cylinder 6 so as to move the right side support 7A to the right side.

Such support of the part A by the positioner 5 is controlled by the general coating layer formation control unit 30 so that it is positioned at a position where the lubricant coating solution B is coated on the coating surface D of the part A by the nozzle 12, which will be explained later, and the coating former 19 forms a coating layer C.

In the state where the part A is supported horizontally by the positioner 5, when the left side conical projection of the positioner 5 is rotated via the left side support 7B by the drive unit 9 under the control of the general coating layer formation control unit 30, the part A rotates along a rotation direction G.

In this way, at the time of formation of the lubricant coating on the part A, the rotating support device 2 cooperates with the general coating layer formation control unit 30 to rotate the part A at a predetermined rotational speed according to need while supporting the part A horizontally.

The rotational speed of the part A is controlled by the general coating layer formation control unit 30 controlling the drive unit 9.

The rotational speed of the part A resulting from the general coating layer formation control unit 30, as will be explained in detail later, can be set differently to a first rotational speed when coating the lubricant coating solution B on the coating surface D of the part A by using the nozzle 12 and a second rotational speed when separating (detaching) the coating former 19 from the coating surface D. Examples of these first and second rotational speeds will be explained later.

Coating Feeder

Figure 5:
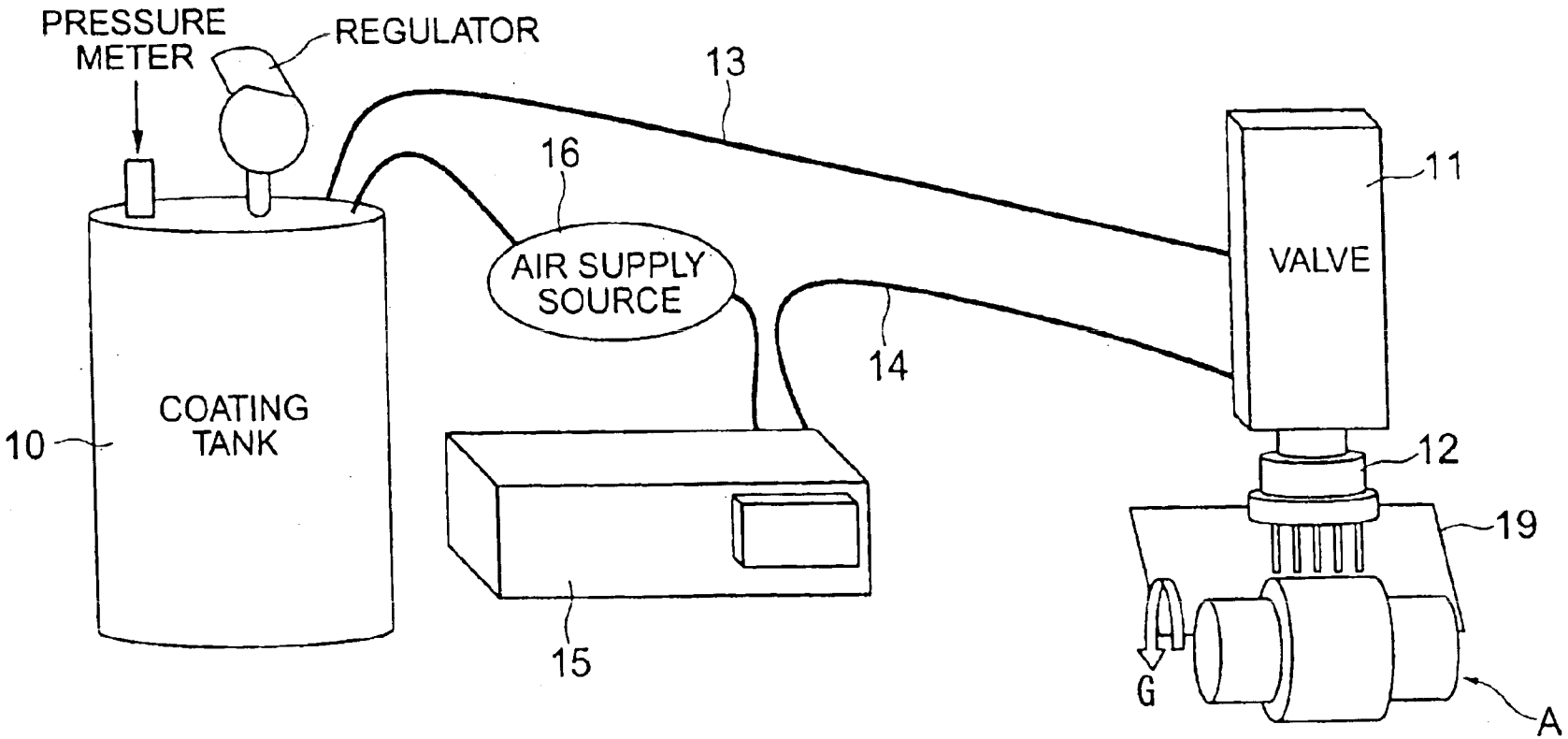
FIG. 5 is a schematic view of the configuration of a coating feeder illustrated in FIG. 1 and FIG. 2.

The coating feeder 3 will be explained next with reference to FIG. 1, FIG. 2, and FIG. 5. FIG. 5 is a view illustrating the schematic configuration of the coating feeder 3.

The coating feeder 3 is comprised of a coating tank 10 containing the lubricant coating solution to be coated on the coating surface D of the part A, valve 11, nozzle 12, coating tube 13, coating tube 13 arranged between the coating tank 10 and the valve 11 to supply the lubricant coating solution to the nozzle 12 via the valve 11, air tube 14, coating feeder control unit 15, air supply source 16, and pressurizing means for pressurizing the inside of the coating tank 10.

As illustrated in FIG. 2, the coating feeder 3 is further comprised of an air pressure cylinder 25 and actuator 18.

The nozzle 12 is mounted on the front end of the valve 11 in a detachable state.

The air supply source 16 provides compressed air (air) for discharging the lubricant coating solution from the coating tank 10 toward the nozzle 12 in response to the control of a regulator disposed in the coating tank. Further, the air supply source 16 provides compressed air to be supplied to the valve 11 via the air tube 14 in response to the control of the coating feeder control unit 15 for discharging the lubricant coating solution from the nozzle 12 toward the coating surface D of the part A.

The coating feeder control unit 15 controls the compressed air discharged from the air supply source 16 in cooperation with the general coating layer formation control unit 30 in order to control the amount etc. of the lubricant coating solution discharged from the nozzle 12 toward the coating surface D of the part A. Details of the control of the amount etc. of the lubricant coating solution will be explained later.

By further controlling the drive of the actuator 18 through the general coating layer formation control unit 30, the valve 11 and the nozzle 12 are elevated and lowered as shown by the broken lines in FIG. 2 so as to be located at suitable positions with respect to the coating surface D of the part A supported by the positioner 5 of the rotating support device 2. Further, the valve 11 and the nozzle 12 can be made to traverse along the coating surface D of the part A. Details of the traversing actions of the valve 11 and the nozzle 12 will be explained later.

In this way, the coating feeder 3 controls the position (up and down position and position in traversing direction) of the nozzle 12 with respect to the coating surface D of the part A in cooperation with the general coating layer formation control unit 30 performing the overall control of the coating layer forming apparatus 1 so that a suitable amount of lubricant coating solution B is supplied to the coating surface D of the part A and so that the lubricant coating solution B is supplied to the coating surface D of the part A uniformly without omission.

Nozzle

Figure 6:
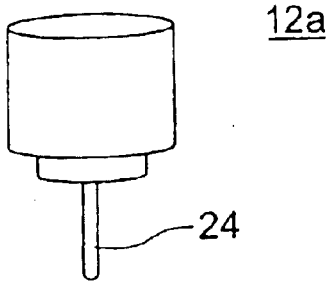
FIG. 6 is a view illustrating the shape of an typical nozzle to be mounted on the coating feeder of the coating layer forming apparatus illustrated in FIG. 1 and a view illustrating the shape of a nozzle with one needle for ejecting the lubricant coating solution.
Figure 7:
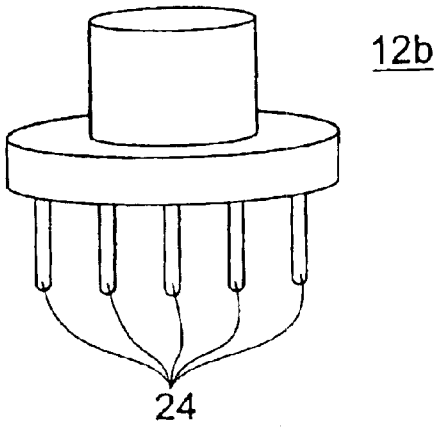
FIG. 7 is a view illustrating the shape of an typical nozzle to be mounted on the coating feeder of the coating layer forming apparatus illustrated in FIG. 1 and a view illustrating the shape of a nozzle with a plurality of aligned needles for ejecting the lubricant coating solution.
Figure 8:
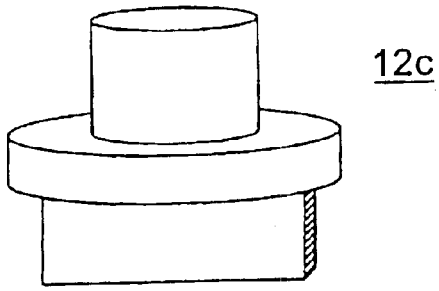
FIG. 8 is a view illustrating the shape of a typical nozzle to be mounted on the coating feeder of the coating layer forming apparatus illustrated in FIG. 1 and a view illustrating the shape of a nozzle wherein the lubricant coating solution is ejected from a flat slit-like outlet.

FIG. 6 to FIG. 8 show illustrative shapes of the nozzle 12. FIG. 6 is a view illustrating the shape of a nozzle having one needle 24 from which the lubricant coating solution is discharged, FIG. 7 is a view illustrating the shape of a nozzle having a plurality of needles 24 arranged in a row from which the lubricant coating solution is discharged, and FIG. 8 is a view illustrating the shape of a nozzle for discharging the lubricant coating solution from a flat slit-like outlet.

As the nozzle 12, a nozzle of any of the shapes illustrated in FIGS. 6 to 8 can be used. Such a nozzle 12 is located above the part A supported at the positioner 5 of the rotating support device 2 while being mounted on the front end of the valve 11 as explained above.

The general coating layer formation control unit 30 controls the drive of the actuator 18 in accordance with the dimensions, shape, range of coating surface D, and the like of the part A to operate the air pressure cylinder 25 to adjust the height of the valve 11 and nozzle 12 and adjust the movement in the horizontal direction along the surface facing the coating surface D, whereby a desired lubricant coating solution B is coated on the coating surface D of the part A.

A comparison of advantages and the like of the nozzles 12 illustrated in FIGS. 6 to 8 will be explained later.

Layer Forming Device

The layer forming device 4, as illustrated in FIG. 1 and FIG. 2, is comprised of the coating former 19, a holder 20 holding the coating former 19, and an angle adjuster 21 for adjusting angles of the holder 20 and the coating former 19 with respect to the coating surface D of the part A. The layer forming device 4 is also comprised of a first actuator 23A for moving the angle adjuster 21 upward and downward and a first drive unit 22A for driving this actuator 23A. The layer forming device 4 is further comprised of a second actuator 23B for moving the actuator 23A where the angle adjuster 21 is mounted in the horizontal direction and a second drive unit 22B for driving this actuator 23B.

The general coating layer formation control unit 30 controls the drive of the drive unit 22B to drive the actuator 23B to move the actuator 23A to the left and right in FIG. 2. The general coating layer formation control unit 30 drives the drive unit 22 A and controls the drive of the actuator 23A to move the position of the angle adjuster 21 upward and downward, and further the general coating layer formation control unit 30 drives the angle adjuster 21 to adjust the angle of the coating former 19 mounted on the holder 20. As a result, the coating former 19 can be brought close to or away (detached) from the coating surface D of the part A supported at the positioner 5 of the rotating support device 2 at any angle and any height with any distance. Details of this operation of the coating former 19 will be explained later with reference to FIG. 10 and FIG. 11.

Figure 9A:
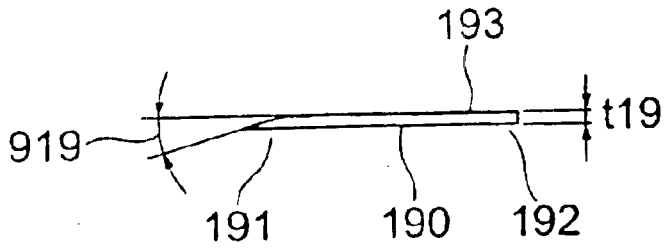
Figure 9B:
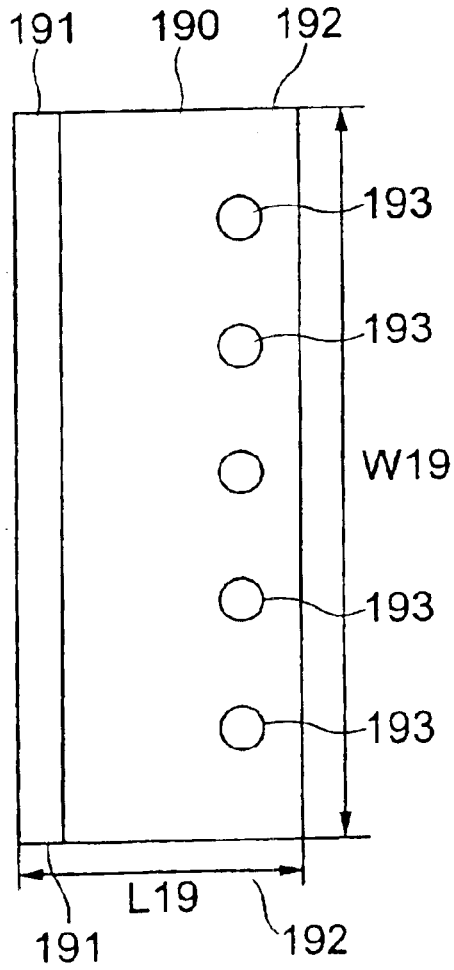

FIGS. 9A and 9B are views illustrating an example of the shape of the coating former 19, wherein FIG. 9A is a sectional view of the coating former 19, and FIG. 9B is a plan view of the coating former 19.

The coating former 19 is comprised of a base 190, a front end 191 exhibiting a blade-like shape at the two sides of the base 190, and a mount end 192 provided with a plurality of holes 193 for mounting it on the holder 20.

The front end 191 is processed into a blade to enable correct spacing of the coating surface D of the part A and the front end 191 of the coating former 19, and enable the excess coating solution E to build up in this spacing part and be transferred to the coating surface D on which the lubricant coating solution B is to be coated next.

The coating former 19 having such a shape and dimensions is brought close to or away from the coating surface D of the part A at the predetermined inclined angle θ under the control of the general coating layer formation control unit 30 as explained above.

In the example illustrated in FIG. 9A and FIG. 9B, a width $W_{19}$ of the coating former 19 is 100 mm, a length $L_{19}$ of the coating former 19 is 23 mm, an angle $a_{19}$ of the blade of the front end 191 is 30°, and a thickness $t_{19}$ of the base 190 is 2 mm.

Basic Operation of Formation of Film of Lubricant Coating Solution

Figure 10:
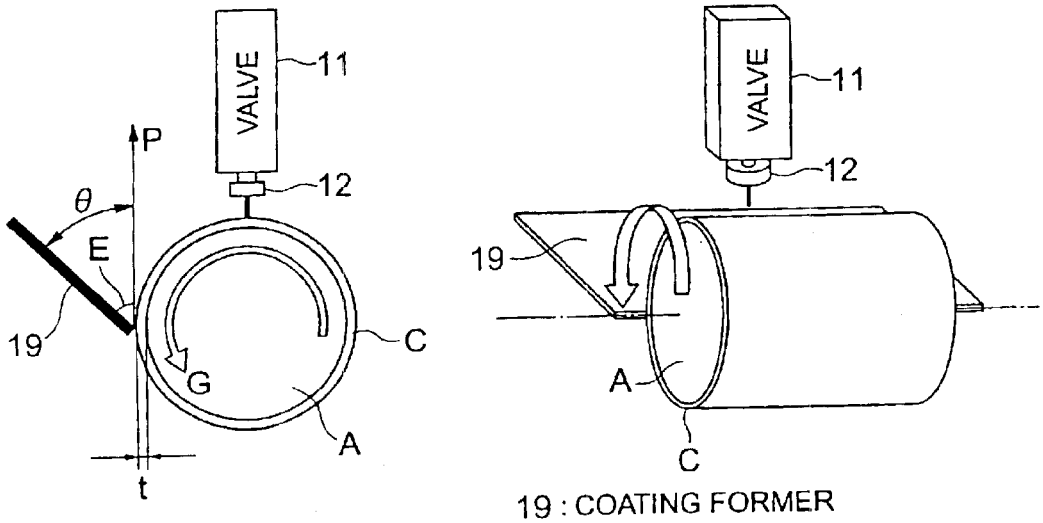
FIG. 10 is a view schematically illustrating a position relationship between the piston (cylindrical base material) illustrated in FIG. 1 and FIG. 2 and the coating former of the layer forming device and the method for formation of the lubricant coating solution on the coating surface of the piston.
Figure 11:
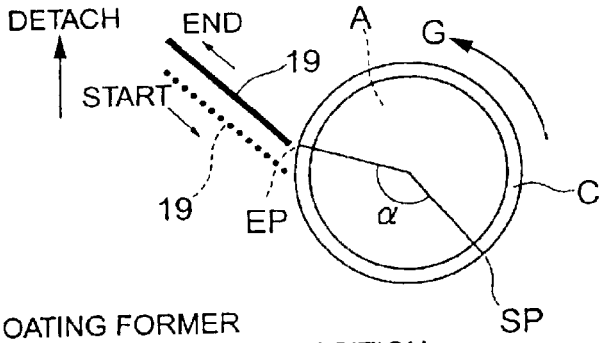
FIG. 11 is a view illustrating a state where the coating former illustrated in FIG. 10 approaches and detaches (separates) from the coated layer of the piston.

The basic operation of the method of formation of a film of the lubricant coating solution on the coating surface D of the part A will be explained with reference to FIG. 10 and FIG. 11. FIG. 10 is a view schematically illustrating the positional relationship between the part A and the coating former 19 and the method of formation of a film of the lubricant coating solution on the coating surface D of the part A, while FIG. 11 is a view illustrating a state where the coating former 19 is brought close to the coating layer C of the part A and then separated from it.

The part A supported at the positioner 5 of the rotating support device 2 rotates in the rotation direction G. The lubricant coating solution guided from the coating tank 10 via the valve 11 is sprayed from the nozzle 12 located above the coating surface D to the coating surface D of this part A, whereby the coating layer C is formed on the part A.

The coating former 19 removes the excess lubricant coating solution E from the coating layer C of the part A to form the coating layer C having a desired thickness "t" by being brought close to the coating surface D of the part A spaced therefrom by exactly the thickness "t" at the inclined angle θ with respect to the tangential direction of rotation "P" of the part A.

Such position adjustment and angle adjustment of the coating former 19 are achieved under the control of the drive units 22A, 22B, actuators 23A, 23B, and angle adjuster 21 by the general coating layer formation control unit 30 as explained above. Namely, as illustrated in FIG. 11, the general coating layer formation control unit 30 controls the first and second actuators 23A, 23B and angle adjuster 21 so that the coating former 19 is brought close to the part A from the detachment start position SP to the detachment end position EP illustrated by broken lines with the thickness "t" and at the inclined angle θ.

The coating layer thickness "t" and the inclined angle θ of the coating former 19 will be explained later.

In this way, in the coating layer forming apparatus 1, in the state where a part A exhibiting a cylindrical shape such as a piston of a compressor rotates while the centering holes F, F are rotatably supported by the positioner 5, the lubricant coating solution supplied from the coating tank 10 of the coating feeder 3 is sprayed to the coating surface D thereof from the nozzle 12. The excess lubricant coating solution E is removed so that the lubricant coating solution sprayed to the coating surface D of the part A becomes the desired coating layer thickness "t" by the coating former 19 having the front end 191 exhibiting the blade-like shape inclined by exactly the inclined angle θ with respect to the tangential direction P of the part A and spaced from the coating layer C of the part A by exactly the thickness t.

The point to be noted here is that the excess coating solution E is not discarded as in the conventional case. The coating former 19 rotates the lubricant coating solution B to bottom of the nozzle 12 and transfers it for use to another portion of the coating surface D to be coated next. As conditions for minimizing the waste of such a lubricant coating solution B, there are for example the inclined angle θ of the coating former, the number of turns (rotational angle) of the part A from when the front end 191 of the coating former 19 starts to separate from the coating layer C of the part A to when it completely finishes being separated, the state of the lubricant coating solution B, and other requirements. Details thereof will be explained later.

Below, a step by step description will be given, of the method of formation of the lubricant coating film on the surface of the cylindrical part A using the coating layer forming apparatus 1.

Figure 12:
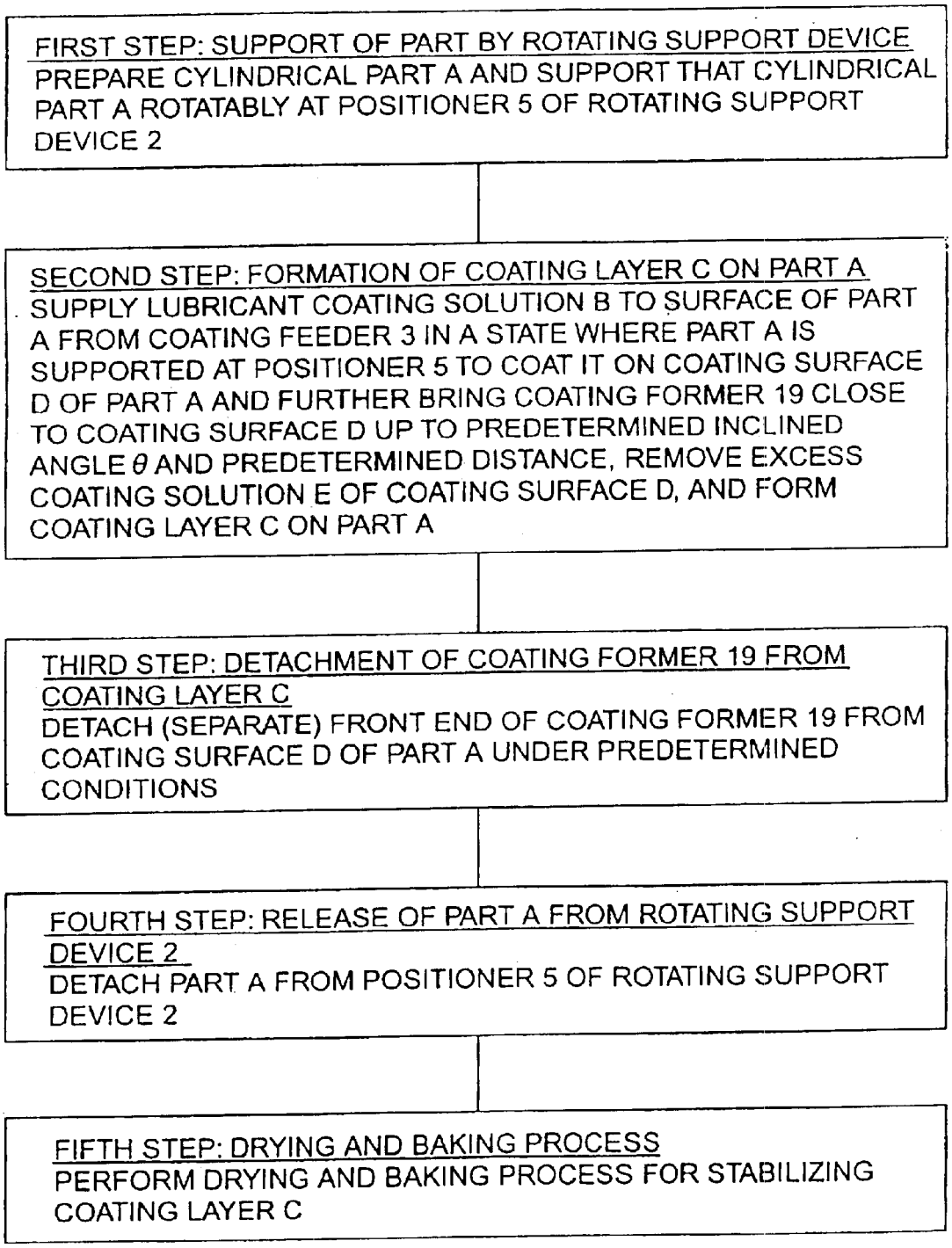
FIG. 12 is a flowchart illustrating steps of an embodiment of the method for formation of a coating film on the surface of a cylindrical base material of the present invention.

The method of the present embodiment for forming the lubricant coating on the surface of the cylindrical part A using the coating layer forming apparatus 1 is roughly comprised of the following five steps (processes) as illustrated in FIG. 12.

A

First step: The cylindrical part A is prepared and the cylindrical part A is rotatably supported at the positioner 5 of the rotating support device 2.

Second step: The lubricant coating solution B is supplied from the coating feeder 3 to the surface of the part A in the state where the part A is supported at the positioner 5 and coated on the coating surface D of the part A. Further, the coating former 19 is brought close to the coating surface D up to the predetermined inclined angle θ and the predetermined distance to remove the excess coating solution E of the coating surface D to thereby form the coating layer C on the part A.

Third step: The coating former 19 is detached (separated) from the coating surface D of the part A.

Fourth step: The part A is detached from the positioner 5 of the rotating support device 2.

Fifth step: A drying and baking process for stabilization of the coating layer C is carried out. The coating layer finished being dried and baked will be referred to as a "finished coating layer C'" for distinguishing it from the coating layer C of the second step. The thickness, the lubrication action, the uniformity, and the like of this finished coating layer C' are important in the part A as a final product.

First Step: Support of Part A by Rotating Support Device 2

The part A as shown in FIG. 4 is formed by machining. The conical projections of the positioner 5 with ends formed into conical projections are engaged with (abutted against) the centering holes F, F of the two end faces of the part A in the rotating support device 2 illustrated in FIG. 1 and FIG. 2 to rotatably support (hold) the part A while maintaining it horizontally. Namely, the right side (second) support 7A can be moved to the left and right in the horizontal direction along the guide rail 8 by the air pressure cylinder 6. The air pressure cylinder 6 moves the support 7A to the right side under the control of the general coating layer formation control unit 30 to move the right side conical projection of the positioner 5 away from the left side of the positioner 5, whereby the part A is arranged between the conical projections of the positioner 5. Then the right side support 7A is moved to the left side along the guide rail 8 by the air pressure cylinder 6 to engage the centering holes F, F of the two end faces of the part A by the conical projections at the two sides of the positioner 5 and thereby support the part A by the positioner 5.

In this state, when the drive unit 9 is controlled by the general coating layer formation control unit 30 to rotate the conical projections of the positioner 5 via the support 7B on the left side, the part A rotates along the rotation direction G. The number of turns of the part A is controlled by control of the drive of the drive unit 9 by the general coating layer formation control unit 30.

Second Step: Formation of Coating Layer C on Part A

The lubricant coating solution B supplied from the coating tank 10 is supplied (discharged) from the nozzle 12 to the coating surface D of the part A while rotating the part A rotatably supported at the positioner 5 of the rotating support device 2 at a first rotational speed so as to coat the lubricant coating solution B on the coating surface D.

The lubricant coating solution is supplied by the coating feeder 3 explained above with reference to FIG. 1, FIG. 2, and FIG. 5.

The lubricant coating solution B is basically supplied in its required amount to the entire coating surface D of the part A as uniformly as possible.

As one method therefor, as illustrated in FIG. 10 and FIG. 11, the rotation direction G of the part A is set to a direction wherein the lubricant coating solution B builds up at the coating former 19. This is because, when if doing this, the lubricant coating solution which the excess coating solution E by the coating former 19 is interposed between the coating former 19 and the coating surface D of the part A and the lubricant coating solution is supplied from the excess coating solution to the coating surface D to which the lubricant coating solution B is to be supplied, whereby waste of the lubricant coating solution B which has become the excess coating solution E is eliminated and the solution is uniformly transferred to the entire coating surface D.

The advantages of the nozzles 12 illustrated in FIG. 6 to FIG. 8 used for coating the lubricant coating solution B on the coating surface D of the part A will now be compared.

When mounting and using a nozzle 12*a* having a single needle 24 illustrated in FIG. 6 as the nozzle 12 on the valve 11, the lubricant coating solution B can be coated on (supplied to) the coating surface D spirally by gradually moving the nozzle 12*a* in parallel along the surface of the part A under the control of the general coating layer formation control unit 30 while rotating the part A supported at the positioner 5. When using such a nozzle 12 a having a single needle, if the speed of movement of the nozzle 12*a* is constant, there is the advantage that the supply of the lubricant coating solution B to the coating surface D becomes uniform. Generally speaking, however, in order to supply the lubricant coating solution B to the entire surface of a broad range of the coating surface D to form the coating layer C by such a coating method, it is necessary to lower the speed of movement of the nozzle 12*a* and rotate the part A a plurality of times at the first rotational speed, therefore it takes time.

Contrary to this, a nozzle 12*b* having a plurality of needles 24 illustrated in FIG. 7 or a nozzle 12*c* having a slit-like outlet illustrated in FIG. 7 can be used to supply the lubricant coating solution B over a broad range of the coating surface D at one time while the part A rotates one time so as to shorten the time and raise the productivity. When using the nozzle 12*b* having a plurality of needles 24 of FIG. 7, however, it is necessary to maintain uniformity of the lubricant coating solution B discharged from the plurality of needles 24. Similarly, even when using the nozzle 12*b* having the slit-like outlet of FIG. 8, it is necessary to maintain the uniformity of the lubricant coating solution B discharged from the longitudinal direction of the slit-like outlet. The maintenance of such uniformity of the lubricant coating solution B is dependent upon the viscosity of the lubricant coating solution B, the pressure of the lubricant coating solution B supplied to the nozzle 12, and the like. Accordingly, adjustment is made so that the lubricant coating solution B becomes uniform over the entire surface of the coating surface D. The viscosity of the lubricant coating solution B will be explained later.

As an issue common to the nozzles 12 illustrated in FIG. 6 to FIG. 8, bubbles may enter (bubbles may be mixed) into the lubricant coating solution B and bubbles may be mixed into the coating layer C due to cavitation caused when the lubricant coating solution B is discharged depending on the design of the nozzle 12 or the amount of discharge of the lubricant coating solution B, so it is necessary to prevent this.

Further, when considering the shortening of the coating time, in other words, the productivity, it is necessary to design the apparatus so that the pressure loss of the lubricant coating solution B is as small as possible.

From the viewpoint of productivity, the higher the rotational speed of the part A, the shorter the time, but this is predicated on a supply capability of the lubricant coating solution B from the coating feeder 3 high enough to handle such a rotational speed of the part A. In this way, there is a close relationship between the rotational speed of the part A and the amount of supply of the lubricant coating solution B. In other words, the control of the rotational speed of the part A performed at the general coating layer formation control unit 30 is determined depending upon the supply capability of the lubricant coating solution B. The supply capability of the lubricant coating solution B is regulated by the pump for pressurizing the solution illustrated in FIG. 5, the diameter of the coating tube 13, the viscosity and temperature of the lubricant coating solution, the design of the shape of the nozzle 12, and the like. Accordingly, these conditions are set so as to able to exhibit the above supply capability.

Below, a concrete example of the relationship between the supply capability of the lubricant coating solution B and the rotational speed of the part A will be explained. For example, if forming the coating layer on a piston having of a width W of the coating surface D of 22 mm and a diameter R of 32 mm, when 1 g of the lubricant coating solution B is supplied to the part A by using the nozzle 12*b* having a plurality of needles 24 shown in FIG. 7, as the condition for forming the coating layer C with a high accuracy when the stable maximum supply capability is 1 g per second in the combination of the coating feeder 3 and the lubricant coating solution B, experiments showed that the first rotational speed of the part A can be set to 60 revolutions per minute (60 rpm). In this case, the general coating layer formation control unit 30 controls the drive of the drive unit 9 to control the part A to a first rotational speed of 60 rpm.

The lubricant coating solution B supplied to the coating surface D of the cylindrical part A is formed on the part A as the coating layer C by the coating former 19 as shown in FIG. 2, FIG. 10, and FIG. 11.

The thickness "t" of the coating layer C is preferably set to a range of for example 0.01 mm to 0.50 mm. More preferably, it was found from experiments that a coating layer thickness "t" set at 0.02 mm to 0.30 mm was good. The reason for this will be explained next. When the thickness "t" of the coating layer C is set to 0.30 mm or more, a considerably long time has to be consumed for the drying and baking in order to prevent foaming at the time of drying and baking in the fifth step, so the productivity becomes low. When the coating layer thickness "t" exceeds 0.50 mm, foaming occurs in the lubricant coating solution B at the time of drying and baking, making it difficult to form the coating layer C obtained after drying and baking to a uniform thickness, and problems arise in quality. On the other hand, when the thickness "t" of the coating layer C is set to 0.01 mm or less, the lubrication action of the finished coating layer C' generated after the drying and baking step becomes insufficient. According to the experiments, as the coating layer thickness "t" by which the lubrication action can be exhibited, it was clarified that 0.30 mm to 0.02 mm is desirable.

In this way, it is one of the final objects of the present invention to make the thickness "t" of the finished coating layer C' after the completion of baking suitable in terms of the final quality by making the coating layer thickness "t" suitable.

The coating former 19 for forming a coating layer C having such a thickness "t" desirably can adjust the inclined angle θ with respect to the tangential direction of rotation P of the coating surface D to an inclined angle θ of 20° to 80° at the point of approach of the coating former 19 to the part A. The grounds for this will be explained later with reference to examples, but the reasons will be summarized here. When the inclined angle θ of the coating former 19 is made smaller than 20□, a contact area of the lubricant coating solution B increases and the projection of the lubricant coating solution B becomes large at a part of the coating layer C. On the other hand, when the inclined angle θ is made 80° or more, the amount of the lubricant coating solution B scraped off by the coating former 19 increases, resulting in the need to supply a large amount of the lubricant coating solution B in the coating feeder 3, so the lubricant coating solution B is wasted.

More preferably, it was clarified that an inclined angle θ set in a range from 30° to 70° was good. The reason for this resides in that, as clear also from examples explained later, when setting the inclined angle θ in such a range, it was recognized that the dimensional accuracy of the finished coating layer C' could be improved.

Note that it is also possible to supply the lubricant coating solution B to the coating surface D of the part A by using a gear pump, diaphragm pump, or other pump in place of the pressurizing type coating tank 10 illustrated in FIG. 5.

Third Step: Detachment (Separation) of Coating Former 19 From Coating Surface D of Part A In the present embodiment, when detaching (separating) the front end 191 of the coating former 19 away from the coating layer C formed in the second step, the detachment start to detachment end operation of the coating former 19 is carried out so that the part A rotating at the second rotational speed rotates by exactly a predetermined number of turns (or predetermined rotational angle) during rotation from the detachment start position SP to the position EP where the detachment completely ends. According to the experiments, this number of turns (or rotational angle) was at least ¼ of a turn.

The "detachment start" means the instant when the coating former 19 starts to leave the coating layer thickness t, while the "detachment end" means the instant when the front end 191 of the coating former 19 is completely separated from the surface of the coating layer of the part A.

When the part A rotates by ¼ of a turn or more at the second rotational speed during detachment of the front end 191 of the coating former 19 from the coating layer C of the part A as shown in FIG. 11, the excess coating solution E, which is the cause of generation of the coating film projection part H, is gradually transferred over a broad area of the coating layer C as a result, so the coating film projection part H can be controlled to be small even if the excess coating solution E is not removed. In order to reduce the coating film projection part H as much as possible, it was learned from the results of the experiments that the part A was preferably rotated two turns or more.

In this way, in order to make the coating film projection part H explained above small, the general coating layer formation control unit 30 controls the drive of the drive unit 9 illustrated in FIG. 1 to perform simultaneously and in parallel the control of the rotation of the part A and the separation of the coating former 19.

The conditions for rotating the part A at least ¼ of a turn in the time from the start of detachment of the coating former 19 from the surface of the coating layer C to when the detachment is completely ended can be controlled according to the movement speed and detachment direction of the coating former 19 under the control of the rotational speed of the part A by the drive of the drive unit 9 by the general coating layer formation control unit 30 and under the control of the actuators 23A, 23B and the angle adjuster 21 illustrated in FIG. 2.

It is advantageous to make the second rotational speed of the part A by the general coating layer formation control unit 30 in the third step a fast rotational speed when considering the production time, but when forming a coating layer on the piston illustrated in FIG. 4 having the width W of the coating surface D of 22 mm and the diameter R of 32 mm, if the second rotational speed exceeds 300 revolutions per minute, scattering of the lubricant coating solution B etc. occur depending on the viscosity of the lubricant coating solution B. According to the experiments, degradation of the surface conditions of the part A such as the entry of bubbles into the surface of the coating layer C of the part A was observed. From such a viewpoint, the second rotational speed of the part A is suitably controlled by the general coating layer formation control unit 30 to 300 rpm or less. Of course, the second rotational speed is determined by the diameter of the part A (dimension of the piston of FIG. 4), so is not fixed to 300 rpm.

The direction for detaching the coating former 19 from the coating layer C is not particularly restricted as far as it is not a direction making the coating layer thickness "t" small, but the tangential direction P of the circumference of the coating layer C or a direction according to that is preferred. By detaching the coating former 19 in the tangential direction P from the coating layer C, the coating former 19 will be gradually separated from the coating layer C.

The detachment speed when detaching the coating former 19 from the coating layer C is determined after determining the second rotational speed and the detachment direction under the state where at least the following conditions are satisfied in the general coating layer formation control unit 30.

The conditions are: (a) The part A is horizontally detachably attached to the rotating support device 2 and the part A is rotated at the second rotational speed, (b) the coating former 19 is inclined to an inclined angle θ in the range from 20 to 80°, preferably a range from 30° to 70°, with respect to the tangential direction of rotation P of the coating surface D and, at the same time, the front end 191 of the coating former 19 is separated from the coating surface D by exactly the thickness "t" from the coating surface D and, in that state, the coating layer C is formed on the coating surface D by the coating former 19 while supplying the lubricant coating solution B to the coating surface D by using the nozzle 12, and (c) the part A is rotated at least ¼ of a turn in the time from when the coating former 19 starts the detachment from the surface of the coating layer C (surface of the supplied lubricant coating solution B) to when the detachment is completely ended.

As the lubricant coating solution B of the piston supplied from the coating feeder 3, for example, one composed of an organic resin as a binder dissolved or dispersed in water or an organic solvent and a PTFE powder as a solid lubricant, including 10 to 100 parts by weight of PTFE powder based on 100 parts by weight of the binder, is used. If the PTFE powder is less than 10 parts by weight based on 100 parts by weight of the binder, the sliding property of the piston is insufficient, while if it is 50 parts by weight or more, the coating strength of the finished coating layer C' after baking is insufficient. Such an incorporation ratio is suitably designed considering the abrasion resistance, sliding property, sealing property, and the like required for a cylindrical part A such as the piston of a compressor.

As the organic resin of the binder, a polyamide resin, polyimide resin, polyamidimide resin, epoxy resin, silicone resin, polyphenylene sulfide resin, phenol resin, polyester resin, urethane resin, and the like were used. These are mixtures of two or more types. Of course, it is possible to incorporate various additives other than these.

As the material incorporated other than these, use can be made of a rheology control agent for adjusting the viscosity characteristic of the coating solution, a metal as the abrasion resistance agent, powder of ceramic, graphite and molybdenum disulfide as the solid lubricant, and a pigment, antifoaming agent, surfactant, or the like as the additive.

The viscosity of the coating solution B is in the range of 100 mPa·s to 20000 mPa·s. A viscosity in the range of 1000 mPa·s to 10000 mPa·s is preferred. If equal to or less than 1000 mPa·s, the coating solution easily drips and the thickness of the coating film is restricted. If equal to or higher than 10000 mPa·s, the leveling ability becomes poor, the coating time becomes longer, and therefore the productivity is reduced.

Note that the viscosity characteristic of the lubricant coating solution B is the value measured using a cone plate type rotary viscometer at a coating temperature of 25° C. and at a shear rate of 100 S(−1) (shear rate) as the measurement conditions.

Fourth Step: Release of Part A from Rotating Support Device 2

When the coating layer C is formed on the part A and the drying work is completed, the part A is released from the positioner 5 by a method reverse to the method explained in the first step.

Fifth Step: Drying and Baking Process

The part A on which the coating layer C is formed released from the positioner 5 is dried and baked in a drying chamber or the like.

Below, experimental results based on the embodiment explained above will be explained.

Representative Example

The method of forming a coating film on the surface of a cylindrical and tubular base material of a representative example according to the first embodiment of the present invention using the coating layer forming apparatus 1 will be explained next. Description of the processes of the first step and the fourth step will be omitted.

(1) Process of Second Step

The general coating layer formation control unit 30 causes the valve 11 to operate while causing the part A to rotate at the first rotational speed by the rotating support device 2 and, for example, causes the lubricant coating solution B to be discharged to the coating surface D of the part A using for example the nozzle 12*b* having a plurality of needles 24 illustrated in FIG. 7.

The amount of discharge of the lubricant coating solution B is adjusted by the pressure of the air from the air supply source 16 applied to the coating tank 10 in advance. The time for discharging the lubricant coating solution B is set in advance by the coating feeder control unit 15.

The general coating layer formation control unit 30 controls the apparatus to set the inclined angle θ of the coating former 19 with respect to the tangential direction P to 0° to 80°, preferably 20° to 80°, for example 45°, via the angle adjuster 21. Further, the general coating layer formation control unit 30 drives the drive units 22A and 22B (actuators 23A, 23B) to separate the front end 191 of the coating former 19 from the surface of the part A by exactly the coating layer thickness "t".

In this example, the general coating layer formation control unit 30 drove the drive unit 9 to cause the part A to rotate at 60 revolutions per minute (60 rpm) as the first rotational speed.

The lubricant coating solution B was supplied from the coating feeder 3 in an amount of 0.6 g per second and the coating layer thickness "t" was set at 0.25 mm.

The lubricant coating solution B supplied to the part A forms the coating layer C on the part A while being partially scraped off by the front end 191 of the coating former 19.

At this point, the front end 191 of the coating former 19 contacts the coating layer C of the rotating part A, and part of the lubricant coating solution B is deposited on the coating former 19 as the excess coating solution E.

(2) Process of Third Step

The general coating layer formation control unit 30 controls the drive units 22A, 22B of the layer forming device 4 to cause the coating former 19 to be detached from the coating layer C of the part A. The conditions for detachment at this time are important. They were set as follows in the present embodiment.

In the time from the start to the end of detachment, the front end 191 of the coating former 19 contacting the coating layer C is gradually separated under the control of the drive unit 9 by the general coating layer formation control unit 30 so that the number of turns (rotational angle) by which the part A rotating at the second rotational speed becomes at least ¼ of a turn, whereby the excess coating solution E scraped off from the coating surface D by the coating former 19 is transferred to the coating layer C as part of the lubricant coating solution B to the coating surface D to be next coated. In this way, the excess coating solution E is not discarded, but is effectively used as part of the lubricant coating solution B.

In this example, the first rotational speed of the part A which was 60 rpm in the second step was raised to 200 revolutions per minute (200 rpm) as the second rotational speed, and the coating former 19 was detached from the coating layer C at a speed of 1 mm per min in the tangential direction of rotation P (upward) of the coating layer C. During this operation, the part A rotated about 7 turns.

(3) Process of Fifth Step

After the detachment of the part A from the positioner 5 in the fourth step, as the process of the fifth step, the part A with the coating layer C formed by the above work was dried and baked to form a stable finished coating layer C' and a part A having the desired lubrication action and coating layer thickness "t" was obtained.

The part A having the finished coating layer C' formed by this method satisfied the prescribed value for the lubrication action of its lubricant coating. The finished coating layer C' was uniform over the entire surface of the coating surface D, there was no waste of the lubricant coating solution B, and the processing time was short.

Examples 1 to 6 and Comparative Examples 1 and 2

Further concrete Examples 1 to 6 according to the present invention and Comparative Examples 1 and 2 will be explained next.

As the part A, the piston illustrated in FIG. 4 having a width W of the coating surface D of 22 mm and a diameter R of 32 mm was used.

In Examples 1 to 6 of the present invention and Comparative Example 1, the coating layer forming apparatus 1 shown in FIG. 1 was used to process the cylindrical part A illustrated in FIG. 4 to obtain the coated object. Note, however that an apparatus illustrated in FIG. 14 was used as the apparatus of Comparative Example 2.

As the coating former 19 of the layer forming device 4, the one shown in FIG. 9 was used. Namely, the coating former 19 used had a width $W_{19}$ of the coating former 19 of 100 mm, a length $L_{19}$ of the coating former 19 of 23 mm, an angle $a_{19}$ of the blade of the front end 191 of 30°, and a thickness $t_{19}$ of the base 190 of 2 mm. In this way, the width $W_{19}$ of the coating former 19 was sufficiently broad, so the former was sufficiently broader than the width of the coating surface D of the part A and could sufficiently cover the coating surface D. Accordingly, the excess coating solution E did not drip from the coating former 19, and the excess coating solution E could be effectively transferred. Also, the width of the coating former 19 was sufficiently broader than the coating surface D of the part A, therefore it was not necessary to move the former along the surface of the coating surface D like the nozzle 12 but need only be detached from the coating layer C.

As the lubricant coating solution B, one having a coating film component concentration of 35% by weight, containing PTFE powder in 30% by weight in the coating film component, and having a viscosity of 6000 mpa·s was used.

EXAMPLE 1

The conditions of Example 1 will be explained next.

First, the part A was supported by the positioner 5 of the rotating support device 2 of the coating layer forming apparatus 1 as a first step.

Thereafter, as a second step, while rotating the part A 60 revolutions per minute (60 rpm) as the first rotational speed under the control of the general coating layer formation control unit 30, the lubricant coating solution B was supplied to the coating surface D of the part A in rings in one second (part A rotated one turn in this one second) through the nozzle 12*b* shown in FIG. 7 integrally provided with five needles 24, which were prepared so as to be able to supply the lubricant coating solution B to positions of five points equally divided into five in the longitudinal direction of the part A. At the same time, the inclined angle θ of the coating former 19 was set at 45° and the front end 191 of the coating former 19 was brought close to the coating surface D of the part A so that the coating layer thickness "t" became 0.25 mm.

Then, as a third step, the rotation of the part A was raised to 200 revolutions per minute (200 rpm) as the second rotational speed under the control of the general coating layer formation control unit 30, and the coating former 19 was detached from the coating surface D in the tangential direction of rotation P (upward) of the coating layer C of the part A at a speed of 1 mm per min. At this time, the number of turns of the part A rotating from the start of detachment to the end of detachment of the front end 191 of the coating former 19 was made about 7 turns.

Further, as a fourth step, the part A on which the coating layer C was formed was detached from the rotating support device 2.

Thereafter, as a fifth step, the detached part A was dried and baked in an electric furnace set at predetermined drying and baking conditions to stabilize the coating layer C and form the finished coating layer C'.

The above work was repeated for coating under the same conditions. The amount of the lubricant coating solution B used was found for the coating projection part H and the finished coating layer C'. The results thereof are shown in Table 1.

TABLE 1

| | No. of turns of part from start to end of detachment of coating former | Amount of coating solution used (per piece) | Coating projection | Thickness of coating layer C' |
|---|---|---|---|---|
| Ex. 1 | About 7 turns | 0.58 g | 0.006 | 0.058 mm |
| Ex. 2 | About 4.0 turns | 0.58 g | 0.005 | 0.058 mm |
| Ex. 3 | About 2.0 turn | 0.59 g | 0.006 | 0.058 mm |
| Ex. 4 | About 1.4 of a turn | 0.58 g | 0.009 | 0.058 mm |

TABLE 1-continued

| | No. of turns of part from start to end of detachment of coating former | Amount of coating solution used (per piece) | Coating projection | Thickness of coating layer C' |
|---|---|---|---|---|
| Ex. 5 | About 0.4 of a turn | 0.59 g | 0.012 | 0.058 mm |
| Ex. 6 | About ¼ of a turn | 0.59 g | 0.014 | 0.057 mm |
| Comp. Ex. 1 | About ⅛ of a turn | 0.59 g | 0.025 | 0.057 mm |
| Comp. Ex. 2 | About ⅛ of a turn | 0.66 g | 0.020 | 0.052 mm |

Figure 13:
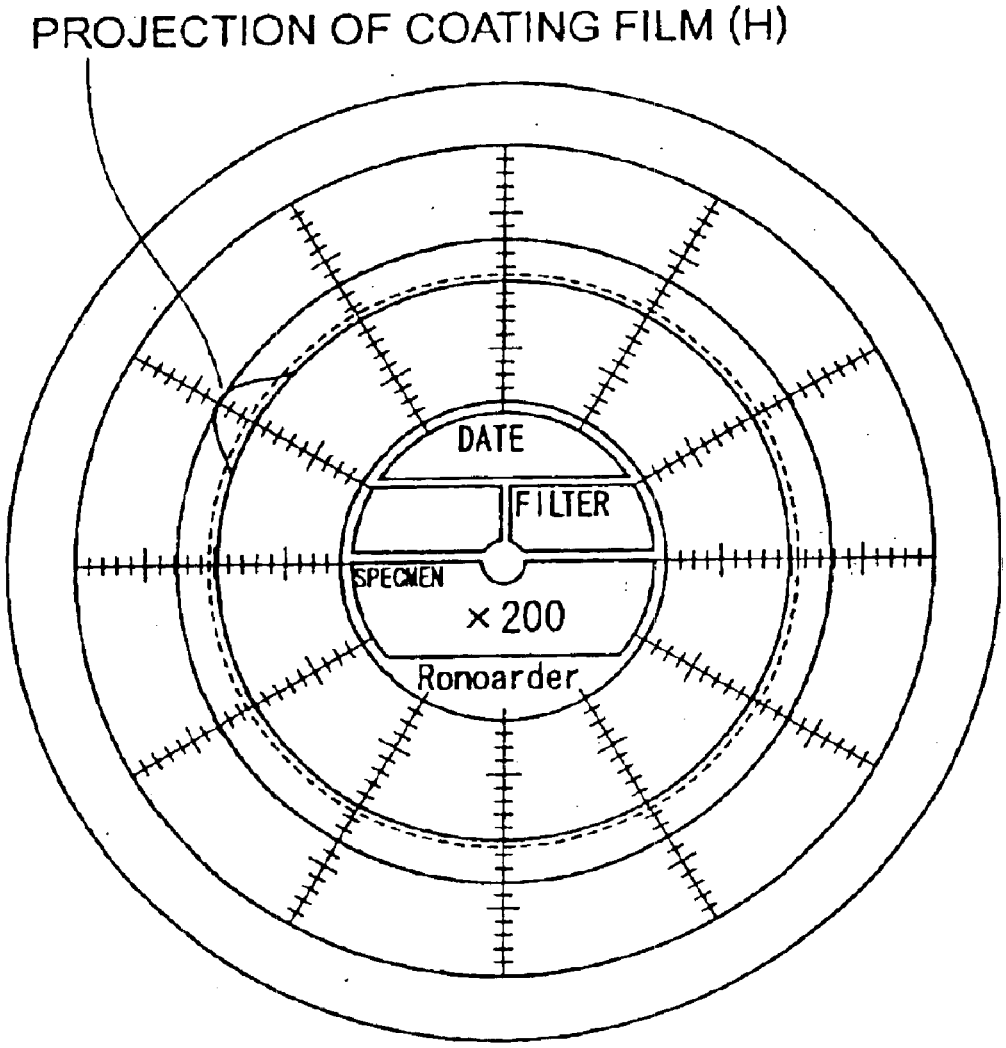
FIG. 13 is a circularity chart showing the degree of a projection portion of the coating layer of a part.

The coating projection part H was measured by using a circularity chart showing the circularity illustrated in FIG. 13.

The results of Example 1, wherein the first rotational speed of the part A in the second step was 60 rpm, the second rotational speed of the part A in the third step was 200 rpm or less than the allowable range of 300 rpm, the inclined angle θ of the coating former 19 was 45°, i.e., in the allowable range of the inclined angle θ of 20 to 80°, the number of turns of the part A rotating from the start of detachment to the end of detachment of the front end 191 of the coating former 19 was about 7 turns of ¼ or more, and the coating layer thickness t was in the preferred range from 0.02 to 0.30 mm, were good results, that is, the amount of the lubricant coating solution B used was 0.58 g per part A, the coating projection part H was 0.006 mm, and the thickness of the finished coating layer C' was 0.058 mm.

EXAMPLE 2

The conditions of Example 2 will be explained next. In Example 2, the experiment was carried out under the same conditions as those for Example 1 except that the detachment speed of the coating former 19 was set to 2.0 mm per min from the 1 mm per min of Example 1 and that the number of turns of the part A rotating from the start of detachment to the end of detachment of the front end 191 of the coating former 19 was changed from the about 7 turns of Example 1 to about 4 turns. The results thereof are shown in Table 1.

The amount of the lubricant coating solution B used in Example 2 was the same as that of Example 1, that is, 0.58 g per part A, the coating projection part H was 0.005 mm, and the thickness of the finished coating layer C' was 0.058 mm or the same as that of Example 1.

In this way, in Example 2, in the same way as Example 1, the first rotational speed of the part A in the second step, the second rotational speed of the part A in the third step, the inclined angle θ, the number of turns of the part A rotating from the start of detachment to the end of detachment of the front end 191 of the coating former 19, and the coating layer thickness t were set in the allowable range explained above and similar results to those of Example 1 were obtained. In other words, even if the detachment speed of the coating former 19 was raised from the 1 mm of Example 1 to 2 mm, similar results to those of Example 1 were obtained. Further, even if the number of turns of the part A rotating from the start of detachment to the end of detachment of the front end 191 of the coating former 19 was reduced to about 4 turns, it is still a number of turns equal to or greater less than ¼, so it was found that there was no problem.

EXAMPLE 3

The conditions of Example 3 will be explained next. In Example 3, the experiment was carried out under the same conditions as those for Example 1 except the detachment speed of the coating former 19 was set to 4.0 mm per min from the 1 mm per min of Example 1, and the number of turns of the part A rotating from the start of detachment to the end of detachment of the front end 191 of the coating former 19 was changed from about 7 turns of Example 1 to about 2 turns. The results thereof are shown in Table 1.

The amount of the lubricant coating solution B used in Example 3 was 0.59 g per part A, the coating projection part H was 0.006 mm or the same as that of Example 1, and the thickness of the coating layer C was 0.058 mm or the same as that of Example 1.

In this way, in Example 3, in the same way as Example 1, the first rotational speed of the part A in the second step, the second rotational speed of the part A in the third step, the inclined angle θ of the coating former 19, the number of turns of the part A rotating from the start of detachment to the end of detachment of the front end 191 of the coating former 19, and the coating layer thickness t were set in the allowable range explained above and similar results to those of Example 1 were obtained. In other words, even if the detachment speed of the coating former 19 was raised from the 1 mm of Example 1 to 4 mm, similar results to those of Example 1 were obtained. Further, even if the number of turns of the part A rotating from the start of detachment to the end of detachment of the front end 191 of the coating former 19 was reduced to about 2 turns, it is still a number of turns equal to or greater than ¼, so it was found that there was no problem.

EXAMPLE 4

The conditions of Example 4 will be explained next. In Example 4, the experiment was carried out under the same conditions as those for Example 1 except the inclined angle θ of the coating forming portion of the coating former 19 was set to 100 (inclined angle θ=10°) or out of the allowable range from 20 to 80°, and the number of turns of the part A rotating from the start of detachment to the end of detachment of the front end 191 of the coating former 19 was changed from about 7 turns of Example 1 to about 1.4 turns. The results thereof are shown in Table 1.

The amount of the lubricant coating solution B used in Example 4 was 0.58 g per part A or the same as that of Example 1, the coating projection part H was 0.009 mm, and the thickness of the coating layer C was 0.058 mm or the same as that of Example 1.

In this way, the number of turns of the part A rotating from the start of detachment to the end of detachment of the front end 191 of the coating former 19 was ¼ of a turn or more in the allowable range, but when the inclined angle θ of the coating former was set at an angle out of the allowable range, the coating projection part H increased from 0.006 mm to 0.009 mm.

EXAMPLE 5

The conditions of Example 5 will be explained next. In Example 5, the experiment was carried out under the same conditions as those for Example 1 except the inclined angle θ of the coating forming portion of the coating former 19 was set in a direction perpendicular to the tangential direction P (inclined angle θ=90°) or out of the allowable range from 20 to 80°, the number of turns of the part A rotating from the start of detachment to the end of detachment of the front end 191 of the coating former 19 was changed from about 7 turns of Example 1 to about 0.4 of a turn, and also the second rotational speed of the part A in the third step was set at 300 revolutions per minute or in the allowable range. The results thereof are shown in Table 1.

The amount of the lubricant coating solution B used in Example 5 was 0.59 g per part A, the coating projection part H was 0.012 mm, and the thickness of the coating layer C was 0.058 mm or the same as that of Example 1.

The number of turns of the part A rotating from the start of detachment to the end of detachment of the front end 191 of the coating former 19 was ¼ of a turn or more in the allowable range, and also the second rotational speed of the part A in the third step was in the allowable range, but when the inclined angle θ of the coating forming portion was set at 90° or out of the allowable range, the coating projection part H increased to 0.012 mm.

EXAMPLE 6

The conditions of Example 6 will be explained next. In Example 6, the experiment was carried out under the same conditions as those for Example 1 except the inclined angle θ of the coating forming portion of the coating former 19 was set to the direction perpendicular to the tangential direction P (inclined angle θ=90°) or out of the allowable range from 20 to 80° in the same way as in Example 5, and the number of turns of the part A rotating from the start of detachment to the end of detachment of the front end 191 of the coating former 19 was changed from about 7 turns of Example 1 to about ¼ of a turn of the allowable limit. The results thereof are shown in Table 1.

The amount of the lubricant coating solution B used in Example 6 was 0.59 g per part A, the coating projection part H was 0.014 mm, and the thickness of the coating layer C was 0.057 mm.

The number of turns of the part A rotating from the start of detachment to the end of detachment of the front end 191 of the coating former 19 was the limit of the allowable range, and also the second rotational speed of the part A in the third step was in the allowable range, but when the inclined angle θ of the coating forming portion was set at 90° or out of the allowable range, the coating projection part H increased to 0.014 mm.

Comparative Example 1

The conditions of Comparative Example 1 will be explained next. In Comparative Example 1, the experiment was carried out under the same conditions as those for Example 1 except the inclined angle θ of the coating forming portion of the coating former 19 was set to the direction perpendicular to the tangential direction P (inclined angle θ=90°) or out of the allowable range from 20 to 80° in the same way as Examples 5 and 6, the number of turns of the part A rotating from the start of detachment to the end of detachment of the front end 191 of the coating former 19 was changed from the about 7 turns of Example 1 to about ⅛ of a turn or lower than the allowable limit, and also the second rotational speed of the part A in the third step was set to 100 revolutions per minute. The results thereof are shown in Table 1.

The amount of the lubricant coating solution B used in Comparative Example 1 was 0.59 g per part A, the coating projection part H was 0.025 mm, and the thickness of the finished coating layer C' was 0.057 mm.

In Comparative Example 1, the inclined angle θ of the coating forming portion was set to an angle out of the allowable range, and further the number of turns of the part A rotating from the start of detachment to the end of detachment of the front end 191 of the coating former 19 was made less than the limit, so the coating projection part H was a large 0.025 mm.

Comparative Example 2

The conditions of Comparative Example 2 will be explained next. As Comparative Example 2, the inclined angle θ of the coating forming portion of the coating former 19 was set to the direction perpendicular to the tangential direction P (inclined angle θ=90°) or out of the allowable range from 20 to 80° in the same way as Examples 5 and 6 and Comparative Example 1, the number of turns of the part A rotating from the start of detachment to the end of detachment of the front end 191 of the coating former 19 was made about ⅛ of a turn or less than the allowable limit in the same way as Comparative Example 1, and the second rotational speed of the part A in the third step was set at 100 revolutions per minute. Further, whenever the coating was repeated, the excess coating solution E deposited on the coating former 19 was removed every time by using the device illustrated in FIG. 14. The experiment was carried out under the same conditions as those of Example 1 other than the above. The results thereof are shown in Table 1.

Figure 14:
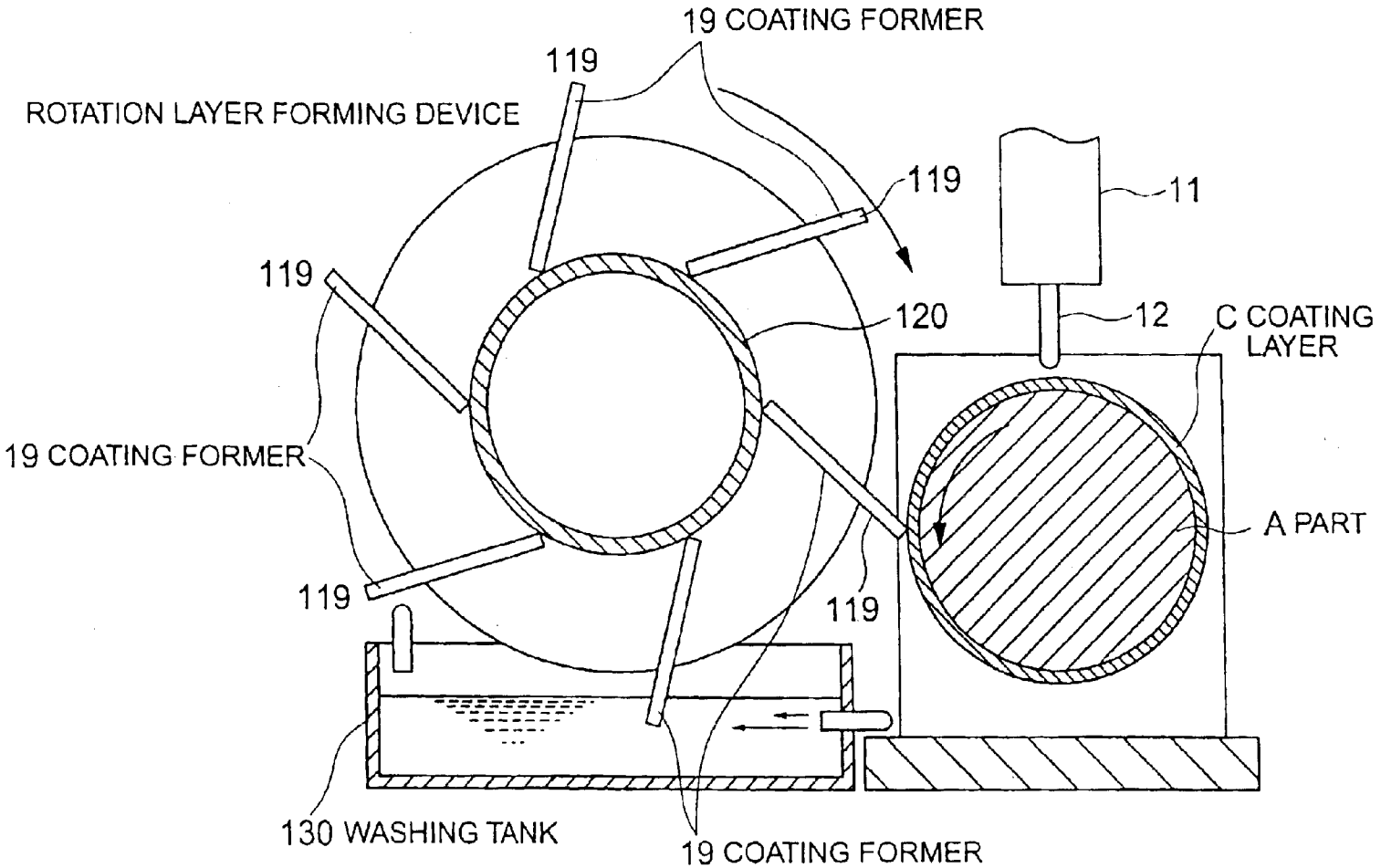
FIG. 14 PRIOR ART
FIG. 14 is a view of the configuration of a device for removing excess coating solution used in Comparative Example 2.

The coating layer forming apparatus illustrated in FIG. 14 is the apparatus disclosed in Japanese Patent Application No. 11-7552. In this apparatus, a plurality of coating formers 119 are mounted along the surface of a rotating body 120, the lubricant coating solution B is coated on the surface of the part A while sequentially switching among the plurality of coating formers 119, and the excess lubricant coating solution is removed by washing in the washing tank 130 during that process.

The amount of the lubricant coating solution B used in Comparative Example 2 was a large 0.66 g per part A, the coating projection part H was a high 0.020 mm, and the thickness of the coating layer C was a thin 0.052 mm.

In Comparative Example 2, the inclined angle θ of the coating former was set at an angle out of the allowable range and further the number of turns of the part A rotating from the start of detachment to the end of detachment of the front end 191 of the coating former 19 was made less than the limit, so the coating projection part H was a large 0.025 mm. Further, the apparatus illustrated in FIG. 14 was used, so the amount of the lubricant coating solution B used was a large 0.66 g.

Evaluation of Examples 1 to 6

When analyzed overall, the results of Examples 1 to 6 of the present invention performed under the above conditions using the coating layer forming apparatus 1 were as follows. In contrast to Comparative Examples 1 and 2, the amount of the lubricant coating solution B used was stably small and also the thickness of the finished coating layer C' was uniform. Also the coating projection part H was stably low, but as seen in Examples 5 and 6, when the inclined angle θ was set at an angle out of the allowable range, the coating projection part H became slightly large. In other words, when performing the above method of formation of a coating film on the surface of a cylindrical base material such as a piston under the above conditions by using the coating layer forming apparatus 1 illustrated in FIG. 1 and FIG. 2, there is no waste of removing the excess coating solution E deposited on the coating former 19, that is, there is little waste of the expensive lubricant coating solution B, so the piston of the compressor can be produced at a low cost.

Also, according to the present embodiment, the coating projection part H can be kept small, so a piston of a compressor having a uniform thickness "t" of the coating layer C, a high lubrication action (high sliding property), and a high abrasion resistance can be produced. Particularly, the quality of the finished coating layer C' is high.

Further, by raising the first and second rotational speeds of the part A, raising the detachment speed of the coating former 19, and setting the number of turns of the part A rotating from the start of detachment to the end of detachment of the front end 191 of the coating former 19 at a suitable value in the allowable range, the processing time can be shortened and the productivity can be raised.

Note that, as seen from Examples 4 to 6, when the inclined angle θ of the coating forming portion is set at an angle out of the range from 20 to 80°, the coating projection part H increases. Also, as seen from Examples 1 to 3, in the range of the above conditions, there is not that much of an effect even if the detachment speed of the coating former 19 is raised. Accordingly, from the viewpoint of productivity, the detachment speed of the coating former 19 can be raised. Further, as seen from Examples 1 to 6, the number of turns of the part A rotating from the start of detachment to the end of detachment of the front end 191 of the coating former 19 should be made at least about ¼ of a turn, preferably 2 turns.

The various control procedures under the above conditions, for example, the control of the rotational speed of the part A, the control of the speed for detaching the coating former 19 from the coating layer C of the part A, the control of the detachment direction, and the control for approaching the coating surface D, can be carried out by the general coating layer formation control unit 30. Therefore, such conditions may be stored in the memory in the general coating layer formation control unit 30, and the execution thereof is easy. Further, the reproducibility is high, so a large amount of pistons of a high quality can be produced without variation in the finished coating layer C'.

The various numerical values explained above are only examples. For example, it goes without saying that the first and second rotational speeds etc. naturally become different values if the dimensions of the piston differ.

Above, a method of formation of a layer of a lubricant coating on a piston by using the lubricant coating solution B was described, but the invention is not limited to formation of a film of a lubricant. The present invention can be applied to the methods of formation of various other coating films for uniformly coating the coating solution on various cylindrical base materials.

The method of formation of a coating film on the surface of a cylindrical and tubular base material of the present invention and the coating layer forming apparatus used therefor can be applied to various applications for uniformly coating a lubricant coating solution or other coating solution on the surface of various cylindrical base materials (parts).

According to the present invention, a method of formation of a coating film on the surface of a cylindrical base material wherein waste of the lubricant coating or other coating solution can be kept small and a coated film or coating film of a low price and high quality can be formed can be provided.

Further, according to the present invention, a method of formation of a coating film on the surface of a cylindrical base material wherein the thickness of the lubricant coating layer after completion of drying and baking performed as the final step can be maintained at a high accuracy can be provided.

Further, according to the present invention, a method of formation of a coating film on the surface of a cylindrical base material wherein the above requests are satisfied and the productivity is high can be provided.

Further, according to the present invention, a coating layer forming apparatus suitable for working the method of formation of a coating film on the surface of a cylindrical base material can be provided.

What is claimed is:

1. A method of forming a coating film on the surface of a cylindrical base material, said method comprising:

inclining a coating former at an inclined angle in a range of 20° to 80° with respect to a tangential direction of rotation of a coating surface of a cylindrical base material rotatably supported horizontally, making a front end of said coating former approach said coating surface separated by exactly a clearance of a predetermined thickness, and coating a coating solution supplied from a coating feeder on the coating surface of said rotating cylindrical base material under a condition where said cylindrical base material supported at said rotating support device is rotated by exactly a first number of turns at a first rotational speed to form a coating layer, and separating said front end of said coating former from the position which said front end of said coating former approached the coating surface of said cylindrical base material separated therefrom by exactly the clearance of said thickness after said coating solution is coated on the coating surface of said cylindrical base material, and rotating said cylindrical base material at least ¼ of a turn at a second rotational speed from a detachment start position of the front end of said coating former to a position where a detachment has completely ended.

2. The method of forming a coating film on the surface of a cylindrical base material as set forth in claim 1, further including detaching said cylindrical base material from said rotating support device and drying and baking the coating layer part of said cylindrical base material.

3. The method of forming a coating film on the surface of a cylindrical base material as set forth in claim 1, wherein said coating former is made to incline by an inclined angle in a range of 30° to 70° with respect to a tangential direction of rotation of the coating surface of the rotatably horizontally supported cylindrical base material.

4. The method of forming a coating film on the surface of a cylindrical base material as set forth in claim 1, wherein said first rotational speed is defined by a state of said coating solution and a diameter of said coating surface of said cylindrical base material, and said second rotational speed is defined as a speed where said coating solution coated on said coating surface of said cylindrical base material will not scatter due to rotation or cause a change in the thickness of said coating surface.

5. The method of forming a coating film on the surface of a cylindrical base material as set forth in claim 1, wherein use is made of said coating former having said front end formed as a blade.

6. The method of forming a coating film on the surface of a cylindrical base material as set forth in claim 1, wherein said cylindrical base material is a piston used in a compressor.

7. The method of forming a coating film on the surface of a cylindrical base material as set forth in claim 1, wherein said coating solution is coated on said coating surface of said cylindrical material using a nozzle having at least one needle or a nozzle having a slit-shaped outlet.

8. The method of forming a coating film on the surface of a cylindrical base material as set forth in claim 7, wherein said coating layer thickness is in a range of 0.01 mm to 0.50 mm.

9. The method of forming a coating film on the surface of a cylindrical base material as set forth in claim 1, wherein:

the coating layer of said cylindrical base material is a lubricant coating layer, and said coating solution includes a lubricant coating solution having a viscosity at a coating temperature of 25° C. and a shear rate of 100 S(−1) in the range of 100 mPa·s to 20000 mPa·s.

10. The method of forming a coating film on the surface of a cylindrical base material as set forth in claim 9, wherein:

said lubricant coating solution has an organic resin serving as a binder dissolved or dispersed in water or an organic solvent and a solid lubricant of a PTFE powder, and includes 10 to 100 parts by weight of the PTFE powder with respect to 100 parts by weight of the organic resin of said binder.

11. The method of forming a coating film on the surface of a cylindrical base material as set forth in claim 9, wherein the organic resin of said binder is one type or a mixture of two or more types of an organic resin including a polyamide resin, polyimide resin, polyamidimide resin, epoxy resin, silicone resin, polyphenylene sulfide resin, phenol resin, polyester resin, and urethane resin, and the coating solution further includes a rheology control agent for adjusting a viscosity characteristic of the coating, a metal as an abrasion resistance agent, a powder of a ceramic, graphite and molybdenum disulfide as the solid lubricant, and a pigment, antifoaming agent, and surfactant as an additive.

12. The method of forming a coating film on the surface of a cylindrical base material as set forth in claim 11, wherein said coating layer thickness is in a range of 0.02 mm to 0.30 mm.

* * * * *